US008978214B2

(12) United States Patent
Kataoka et al.

(10) Patent No.: US 8,978,214 B2
(45) Date of Patent: Mar. 17, 2015

(54) SEATBELT BUCKLE APPARATUS

(75) Inventors: Goshu Kataoka, Yokohama (JP); Shinya Obata, Yokohama (JP); Toru Nakamura, Yokohama (JP)

(73) Assignee: Autoliv Development AB, Vårgårda (SE)

( * ) Notice: Subject to any disclaimer, the term of this patent is extended or adjusted under 35 U.S.C. 154(b) by 216 days.

(21) Appl. No.: 13/581,995

(22) PCT Filed: Mar. 1, 2011

(86) PCT No.: PCT/JP2011/054560

§ 371 (c)(1),
(2), (4) Date: Aug. 30, 2012

(87) PCT Pub. No.: WO2011/108506

PCT Pub. Date: Sep. 9, 2011

(65) Prior Publication Data

US 2012/0324685 A1 Dec. 27, 2012

(30) Foreign Application Priority Data

Mar. 2, 2010 (JP) ..... 2010-045056

(51) Int. Cl.
*A44B 11/26* (2006.01)
*A44B 11/25* (2006.01)

(52) U.S. Cl.
CPC ..... *A44B 11/2523* (2013.01)
USPC ..... 24/637; 24/641

(58) Field of Classification Search
USPC ..... 24/637, 641, 640, 642, 643, 647, 633, 24/636
See application file for complete search history.

(56) References Cited

U.S. PATENT DOCUMENTS

| | | | | |
|---|---|---|---|---|
| 5,555,609 | A | 9/1996 | Tolfsen et al. | |
| 5,915,633 | A | 6/1999 | Biller | |
| 5,974,638 | A | 11/1999 | Yamaguchi et al. | |
| 7,124,480 | B2 * | 10/2006 | Kawai et al. | 24/633 |
| 7,240,407 | B2 * | 7/2007 | Kawai et al. | 24/641 |
| 2005/0086777 | A1 | 4/2005 | Kawai et al. | |

(Continued)

FOREIGN PATENT DOCUMENTS

| | | |
|---|---|---|
| EP | 0 945 082 | 9/1999 |
| EP | 1 525 815 | 4/2005 |

(Continued)

OTHER PUBLICATIONS

International Search Report of PCT/JP2011/054560 Mailed May 17, 2011 (4 pages).

*Primary Examiner* — Robert J Sandy
*Assistant Examiner* — Abigail Morrell
(74) *Attorney, Agent, or Firm* — Brinks Gilson & Lione

(57) ABSTRACT

A seat belt buckle device in which the jumping or roll-over height of a counterweight is decreased allowing the seat belt buckle device to be reduced in size. The seat belt buckle device includes an outer case into which a tongue plate is inserted, a latch member that latches the tongue plate, a slideable release button, and a counterweight that resists sliding of the release button. The counterweight includes a shaft that engages a bearing groove formed in the release button and receives the force that rotates the counterweight due to the sliding of the release button. The rotating shaft has a recessed portion in its outer circumferential surface with this portion being configured to come into contact with the bearing groove of the release button when the release button slides into the outer case.

19 Claims, 7 Drawing Sheets

(56) References Cited

U.S. PATENT DOCUMENTS

| | | | | |
|---|---|---|---|---|
| 2005/0257354 | A1 | 11/2005 | Kawai et al. | |
| 2008/0163468 | A1 * | 7/2008 | Nakamura et al. | 24/641 |

FOREIGN PATENT DOCUMENTS

| | | |
|---|---|---|
| EP | 1 597 983 | 11/2005 |
| JP | 7-505557 | 6/1995 |
| JP | 2823360 | 11/1998 |
| JP | 11-266907 | 10/1999 |
| JP | 2005-144138 | 6/2005 |
| JP | 2005-328864 | 12/2005 |
| WO | WO 94/08480 | 4/1994 |
| WO | WO 9603896 | 2/1996 |

* cited by examiner

SEATBELT BUCKLE APPARATUS

BACKGROUND

1. Field of the Invention

The present invention relates to a seat belt buckle device that secures a tongue plate provided at a seat belt in a vehicle.

2. Related Technology

A seat belt is a safety device for preventing an occupant from bumping against the inner wall of a vehicle and injuring himself in the event of an accident or the like by restraining the occupant's body in the vehicle seat. A seat belt (webbing) is accommodated by winding on a seat belt retractor (retractor) in the center of a B pillar. The webbing unwound upward from the retractor is supported by a seat belt anchorage (anchorage) in the upper portion of the B pillar and folded back to the interior of the vehicle. A tongue plate is attached to the webbing pulled out from the anchorage. When the tongue plate is inserted into the seat belt buckle (buckle), the webbing applied to the chest and stomach of the occupant restraints the occupant's body.

When the tongue plate is inserted into the buckle, the latch hole of the inserted tongue plate is latched inside the buckle by a latch member provided inside the buckle, thereby securing the tongue plate.

Meanwhile, the seat belt can be taken off by the occupant of the vehicle by pushing the release button of the buckle. The pushed release button slides toward the interior of the buckle. As a result, the latch member (or a lock bar that pushes the latch member toward the tongue plate) rises from the tongue plate, the latching of the latch hole is released, and the tongue plate is discharged. Such a configuration of the buckle makes it possible to latch and unlatch the tongue plate easily.

Where a vehicle is subjected to an impact caused by an accident or the like when the seat belt is worn, the webbing is initially locked against pulling out of the retractor. Since the webbing is instantaneously picked up by a pre-tensioner provided in the retractor or the like, the seat belt tightly holds the occupant's body. Where the webbing is picked up by the pre-tensioner or the webbing then receives and stops the load from the occupant, the buckle is pulled to the tongue side. Alternatively, the buckle is pulled in the direction opposite that of the tongue by the action of the buckle pre-tensioner.

When the buckle moves in the direction of pulling from the initial position (tongue direction or the direction opposite thereto), the release button, which can slide inside the buckle, attempts to become stationary in the initial position under the inertia. Further, after the buckle movement has been stopped, the release button attempts to slide under the inertia in the movement direction of the buckle. Under such inertia action, the release button slides into the buckle and the secured tongue plate can be released during an accident. Accordingly, a counterweight acting as a weight with respect to the release button has been provided inside the buckle so as to prevent the release button from sliding under the inertia.

For example, the buckle disclosed in Japanese Patent Application Publication No. 2005-144138 is provided with a latch member, that latches (fixes) the tongue, and a release button, for releasing the latching of the tongue by the latch member, as the elements for fixing and releasing the tongue. Such a buckle is further provided with an inertia lever (counterweight) that is rotatably provided on a rotating shaft and abuts on the release button, thereby preventing the movement of the release button in the release direction thereof (direction in which the abovementioned latch is released). According to Japanese Patent Application Publication No. 2005-144138, the counterweight reliably maintains the latching of the buckle and the tongue even against the inertia force both in the release direction and non-release direction of the release button.

However, in order to dispose the rotatable counterweight, such as described in Japanese Patent Application Publication No. 2005-144138, in a buckle, it is necessary to provide the space allowing the counterweight to rotate in the buckle. This contradicts a recent trend toward miniaturization of the buckle that is aimed at improving the appearance and securing a free space inside the vehicle cabin. In particular, as the counterweight is increased in length, the jumping height thereof during rotation increases and a wider space is necessary for the rotation thereof. Thus, although the counterweight is necessary to prevent the unexpected release of the tongue plate in the event of collision, the presence of the counterweight limits the miniaturization of the buckle.

SUMMARY

It is an object of the present invention to resolve the above-described problem and to provide a seat belt buckle device in which the jumping height of the counterweight can be restricted and miniaturization can be advanced.

In order to resolve the above-described problems, the representative configuration of the seat belt device in accordance with the present invention is a seat belt buckle device that secures or fixes a tongue plate provided at a seat belt, including an outer case into which the tongue plate is inserted; a latch member that rotates in response to the insertion of the tongue plate into the outer case and latches the tongue plate; a release button that releases the latching of the tongue plate by the latch member by sliding into the outer case; and a counterweight that is rotated by a force received from the release button and resists to the sliding of the release button, wherein the counterweight has: a first rotating shaft that causes the counterweight to rotate with respect to the outer case; and a second rotating shaft that is engaged with a bearing groove formed in the release button and receives the force that rotates the counterweight due to the sliding of the release button, and the second rotating shaft has a portion, a part of an outer circumferential surface of which is missing, with this portion being configured to come into contact with the bearing groove of the release button when the release button slides into the outer case.

Where the abovementioned configuration is compared with that in which the second rotating shaft has a round cross section, although the distance through which the release button is caused to slide when the seat belt is taken off is the same in both configurations, the rotation amount of the first rotating shaft can be reduced. Thus, the jumping height of the counterweight when the latching of the tongue plate is released can be reduced. As a result, the outer case can be reduced in thickness and a smaller outer case can be designed.

The second rotating shaft of the counterweight may come into contact with the bearing groove of the release button by an outer circumferential surface except the portion, a part of an outer circumferential surface of which is missing when the seat belt buckle device fixes the tongue plate, and come into contact with the bearing groove of the release button by the portion, a part of an outer circumferential surface of which is missing when a sliding distance of the release button into the outer case is the largest.

The abovementioned counterweight is a member that functions as a weight that rotates and offers resistance to the sliding of the release button. In a state in which the seat belt buckle device fixes the tongue plate, that is, when the counterweight functions as a weight, the portion of the second rotating shaft in which part of an outer circumferential surface is missing is not in contact with the release button. With such a configuration, the portion of the second rotating shaft in which part of an outer circumferential surface is missing does not affect the counterweight functions and can reduce the aforementioned jumping height.

The seat belt buckle device may further include a lock bar that receives a force from the tongue plate, rotates the latch member toward the tongue plate and latches the latch member, wherein the counterweight has a latching portion that latches the lock bar at a position in which the latch member is latched onto the tongue plate.

With such a configuration, by using the counterweight that rotates relative to the outer case it is possible to aid the latching of the tongue plate with the latch member. As a result, the latched state of the tongue plate in the seat belt buckle device can be maintained more reliably.

The counterweight may be made from a metal and may have an inertia mass larger than that of the release button. With such a configuration, the counterweight can reliably prevent the release button from sliding into the buckle under inertia.

In accordance with the present invention, it is possible to provide a seat belt buckle device in which the jumping height of the counterweight can be restricted and miniaturization can be advanced.

DETAILED DESCRIPTION

Figure 1:
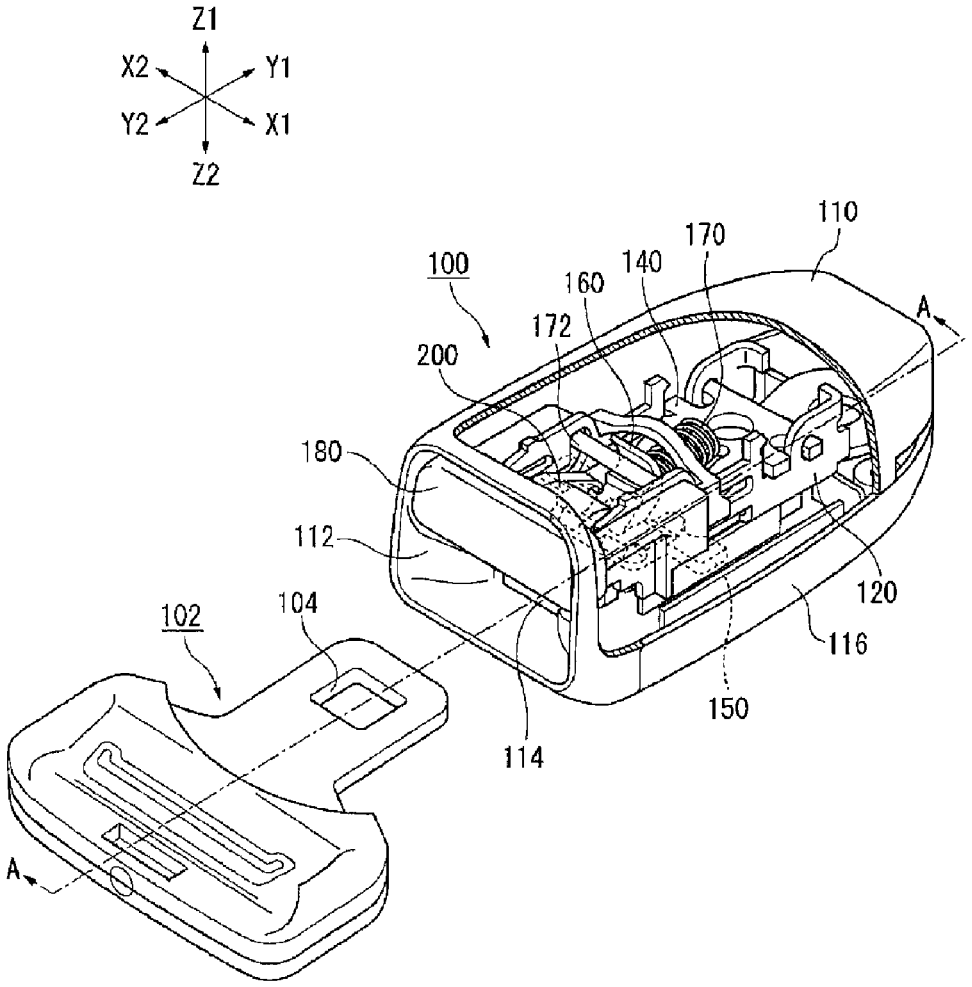
FIG. 1 illustrates the internal configuration of the seat belt buckle device according to the present embodiment.

The preferred embodiments of the present invention will be described below in greater detail with reference to the appended drawings. The dimensions, materials, and other specific numerical values are exemplified to facilitate the understanding of the invention and are not intended to limit the present invention, unless specifically indicated otherwise. Meanwhile in the description of the invention and drawings, the elements having substantially the same function and structure are denoted by the same reference numerals and the redundant explanation thereof will be omitted. In addition, the elements that are not directly related to the invention will not be shown.

(Seat Belt Buckle Device)

Figure 2:
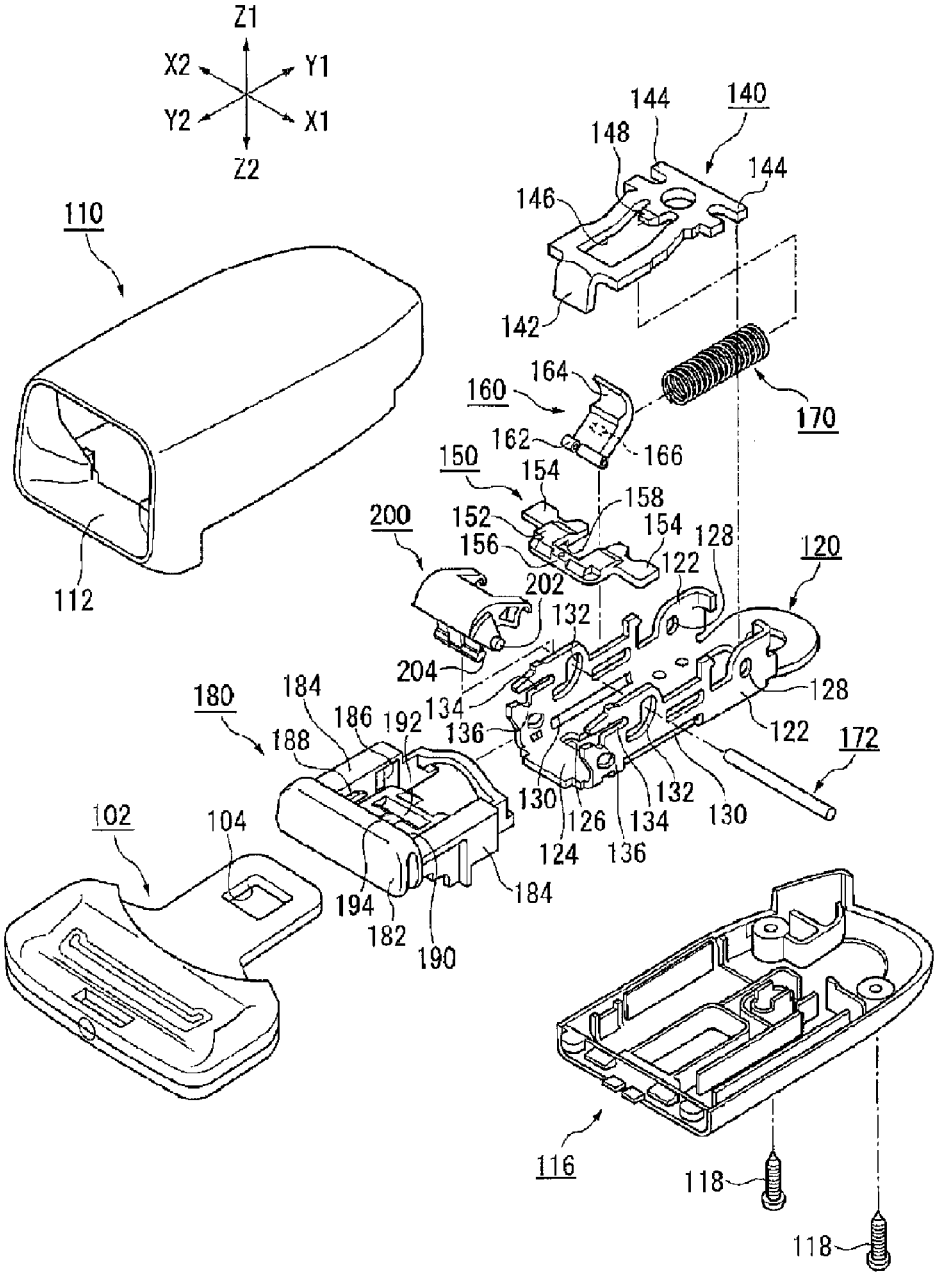
FIG. 2 is an exploded view of the seat belt buckle device shown in FIG. 1.

FIG. 1 illustrates the internal configuration of the seat belt buckle device according to the present embodiment. FIG. 2 is an exploded view of the seat belt buckle device shown in FIG. 1. The seat belt buckle device (referred to hereinbelow as "buckle 100") is a device that fixes a tongue plate 102 provided at the seat belt. The buckle 100 is disposed inside the vehicle cabin so as to be positioned close to the hips of the occupant seating on a seat.

An outer case 110 of the buckle 100 is provided with an opening 112 for inserting the tongue plate 102 and disposing a release button 180. A tongue insertion port 114 (see FIG. 1) is formed at the portion of the opening 112 outside the portion where the release button 180 is disposed. The tongue plate 102 can be fixed (latched) to the buckle 100 by inserting the tongue plate into the tongue insertion port 114, and the latching of the tongue plate 102 can be released by pushing the release button 180. A lower case 116 is fixed by a screw 118 to the lower side of the outer case 110.

A metal frame 120 is provided inside the buckle. As shown in FIG. 2, the frame 120 has a square U-shaped cross-section and is provided with a pair of side walls 122 and a bottom wall 124 provided between the side walls 122. The upper surface of the bottom wall 124 constitutes the insertion path for the tongue plate 102 inside the buckle.

A latch member 140 is provided in the upper portion inside the square U-shaped frame 120. The latch member 140 rotates following the movement of the tongue plate 102 inserted into the outer case 110 and latches onto the tongue plate 102. The latch member 140 is made from a metal and has a latch protrusion 142 that protrudes in the direction to the bottom wall (direction Z2 in the figure) of the frame 120 at the end portion on the tongue insertion port 114 side (Y2 side in the figure). Where the tongue plate 102 is inserted into the outer case 110, the latch protrusion 142 is inserted into a latch hole 104 provided in the tongue plate 102 and then inserted into an orifice 126 provided in the bottom wall 124 of the frame 120.

The latch member 140 has a support arm 144 that projects toward both side walls 122 (direction X1 in the figure and the direction X2 in the figure) of the frame 120 at the end portion on the side (Y1 side in the figure) opposite that of the latch protrusion 142. The support arm 144 engages with a support hole 128 provided at the side wall 122 of the frame 120. As a result, the latch member 140 can rotate toward the bottom wall 124 (direction Z2 in the figure) of the frame 120 and in the opposite direction (direction Z1 in the figure) about the support arm 144.

An opening 146 is provided in the center of the latch member 140. A spring latching projecting portion 148 that projects in the direction to the latch protrusion 142 (direction Y2 in the figure) is provided at the edge of the opening 146 on the support arm 144 side thereof (Y1 side in the figure). An ejector spring 170 that is disposed between the latch member 140 and a cantilever 160 is connected to the spring latching projecting portion 148.

An ejector 150 is provided between the latch member 140 and the bottom wall 124 of the frame 120. The ejector 150 is configured to be capable of sliding in the attachment-detachment direction of the tongue plate 102 on the bottom wall of the frame 120. Where the tongue plate 102 is inserted into the outer case 110, the ejector 150 is brought into contact with the end portion of the tongue plate 102 and pushed there against and slides from the tongue insertion port 114 side toward the rear side (Y1 side in the figure) inside the outer case 110. Further, where the latching of the tongue plate 102 by the latch member 140 is released, the ejector 150 is biased by the ejector spring 170 and slides from the rear side inside the outer case 110 toward the tongue insertion port 114. As the ejector 150 slides in this case, the tongue plate 102 is pushed out of the outer case 110.

The ejector 150 is provided with a base portion 152 of a substantially U-like shape and arm portions 154 extending from both ends of the base portion 152 toward the side wall of the frame 120 (the X1 direction in the figure and the X2 direction in the figure). The arm portions 154 are inserted into slits 130 formed between the side wall 122 and the bottom wall 124 of the frame 120. Since the arm portions 154 can move inside the slits, the ejector 150 has a configuration that can slide in the attachment-detachment direction of the tongue plate 102 on the bottom wall of the frame 120. The base portion 152 is provided with a pushed portion 156 that is the surface on the tongue insertion port side and comes into contact with the end portion of the tongue plate 102 and a holding hole 158 that comes into contact with the cantilever 160 on the inner side of the substantially U-like shape.

The cantilever 160 is a member that uses the repulsion force of the ejector spring 170 to push the latch member 140 by a lock bar 172 toward the tongue plate 102. The cantilever 160 has a shaft 162 that engages with the holding hole 158 of the ejector 150 and is configured to be rotatable about the shaft 162. A bar latching portion 164 formed as a curved surface is provided at the distal end of the cantilever 160. The bar latching portion 164 passes through the opening 146 and is positioned above the latch member 140 to latch onto the lock bar 172 that is also positioned above the latch member 140. A spring holding protruding portion 166 for connecting to the ejector spring 170 is provided on the surface of the cantilever 160 on the side opposite that of the bar latching portion 164 (rear surface in FIG. 2).

The ejector spring 170 is disposed between the spring latching projecting portion 148 of the latch member 140 and the spring holding protruding portion 166 of the cantilever 160. Since the ejector spring 170 is disposed in a compressed state, repulsion forces acting in the direction of pulling the latch member 140 and the cantilever 160 apart from each other act at all times.

The lock bar 172 is a member pushing the latch member 140 from above toward the tongue plate 102. The lock bar 172 has a length equal to or greater than a width of the latch member 140. The lock bar 172 is disposed to span between the guide holes 132 that are formed in a substantially L-like shape in both side walls 122 of the frame 120. As described hereinabove, the bar latching portion 164 of the cantilever 160 latches onto the lock bar 172, and the lock bar can move inside the guide hole 132 as the cantilever 160 rotates.

The release button 180 is provided in the opening 112 side (Y2 side in the figure) of the frame 120 so as to cover both side walls 122 and the upper portions thereof. The release button 180 can freely slide in the attachment-detachment direction of the tongue plate 102 on the frame. The release button 180 has an operation section 182 to be exposed outside from the opening 112 and legs 184 extending into the buckle 100 from both ends of the operation section 182. The distal ends of the legs 184 are connected by an arch-like portion.

The legs 184 of the release button 180 slide on the outer sides of the side walls 122 of the frame 120. An operation recess 186 is provided on the inner side (side wall side of the frame 120) of each leg 184. The end portion of the lock bar 172 protruding from the guide hole 132 of the frame 120 is inserted into the operation recess 186. Where the release button 180 slides in the direction into the buckle 100, the lock bar 172 is pushed in the direction into the buckle 100 (Y1 side in the figure) by the surface of the operation recess 186 on the opening 112 side, comes into contact with the curved edge of the guide hole 132, and moves upward along this edge. As a result, the pressure acting from the latch member 140 on the tongue plate 102 under the effect of the lock bar 172 is released and latching of the tongue plate 102 is released.

A guiding projecting portion 188 is provided on the inner side of each leg 184 on the surface facing the side wall 122 of the frame 120. The guiding projecting portion 188 protrudes along the side wall 122 of the frame 120 and extends toward the distal ends of the operation section 182 and the leg 184. The guiding projecting portion 188 is inserted in a long groove 134 formed in the side wall 122 of the frame 120. When the release button 180 slides, the guiding projecting portion 188 is guided by the long groove 134. Therefore, the release button 180 can slide parallel to the side wall 122 and the bottom wall 124 of the frame 120.

A lower end portion 190 protruding in the direction into the buckle 100 is provided at the bottom wall side of the frame 120 in the operation section 182. A bearing groove 192 extending toward the arms on both sides is formed in the lower end portion 190. A second rotating shaft 204 of a counterweight 200 is engaged with the bearing groove 192. An auxiliary groove 194 for receiving a thick portion 206 located in the vicinity of the second rotating shaft of the rotating counterweight 200 is provided in the bearing groove 192 on the operation section 182 side.

Figure 3:
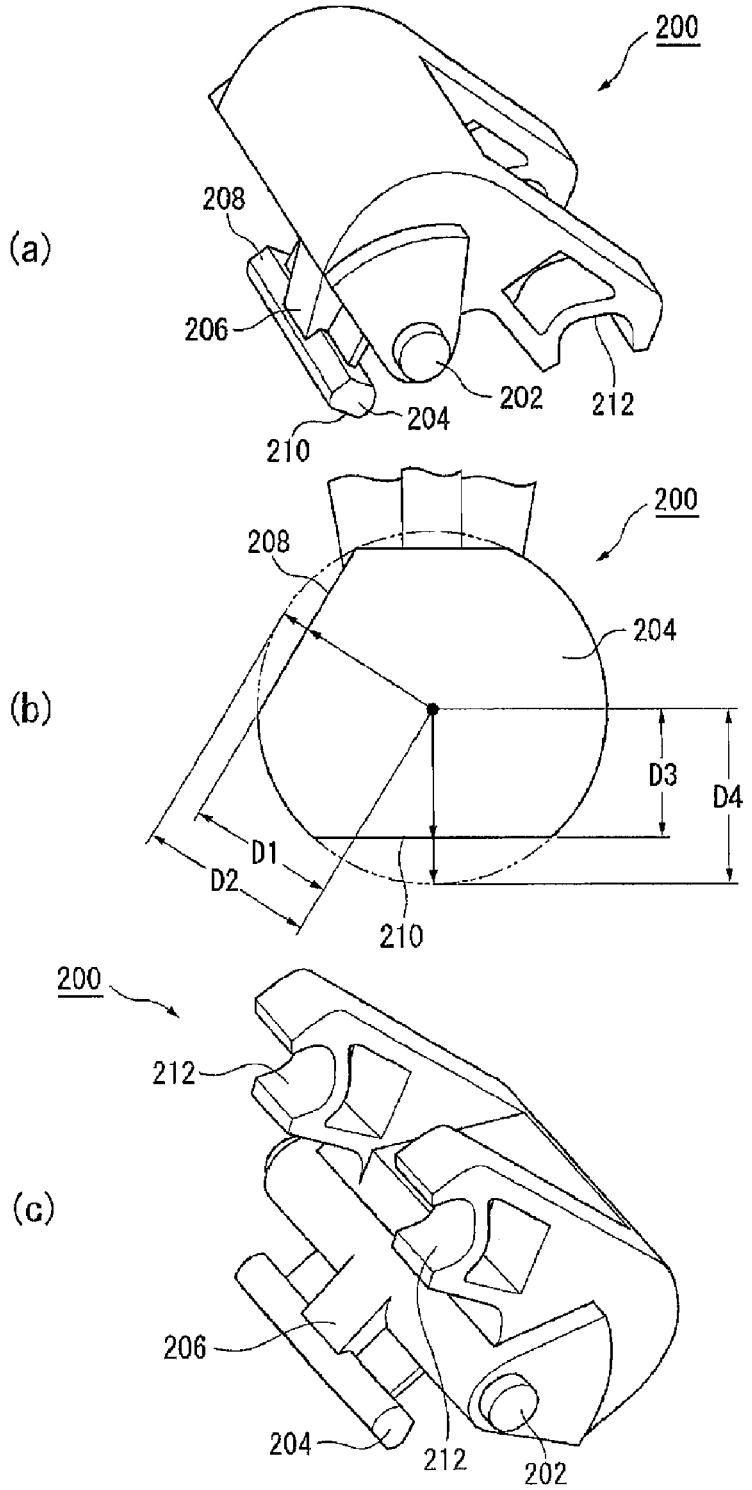
FIGS. 3(*a*) and 3(*c*) are perspective views of the counterweight from opposite sides thereof and FIG. 3(*b*) is a side view of the shaft of the counterweight.

FIG. 3 illustrates the external appearance of the counterweight 200. The counterweight 200 is a member playing the role of a weight acting against the release button 180. As shown in FIG. 3(*a*), the counterweight 200 has a first rotating shaft 202 and the second rotating shaft 204 and can rotate inside the outer case, following the sliding movement of the release button 180.

The first rotating shaft 202 is inserted into the concave groove 136 provided in the side wall 122 of the frame 120 shown in FIG. 2 and enables the rotation of the counterweight 200 with respect to the frame 120 and the outer case 110. The second rotating shaft 204 is engaged with the bearing groove 192 provided in the lower end portion 190 of the release button 180. The second rotating shaft 204 receives the force from the sliding release button 180, rotates the counterweight 200 with respect to the release button 180, and also rotates the counterweight 200 with respect to the outer case 110 about the first rotating shaft 202.

Referring again to FIG. 2, in the event of an accident or the like, an inertia force acting in the direction into the buckle 100 (Y1 direction in the figure) can be generated in the release button 180 connected to the second rotating shaft 204. However, a comparatively weak force such as the inertia force of the release button 180 is canceled by the inertia force of the counterweight 200 that is received from the second rotating shaft 204. Since the center of gravity of the counterweight 200 tries to rotate under the inertia in the direction into the buckle 100 (Y1 direction in the figure) about the first rotating shaft 202, an inertia force in the direction (Y2 direction in the figure) opposite that of the rotation direction of the center of gravity is generated in the second rotating shaft 204. Since the counterweight 200 thus offers the resistance to the sliding movement of the release button 180 inward the buckle 100, the release button 180 cannot slide in the direction into the buckle 100 under the inertia. Therefore, the counterweight 200 prevents the tongue plate 102 from being unintentionally unlatched.

The weight of the counterweight 200 is set such that the center of gravity does not rotate counterclockwise about the first rotating shaft 202 even under inertia. Therefore, the counterweight 200 cannot rotate under the inertia and cause the release button 180 to slide toward the lock bar 172.

The counterweight 200 is made from a metal and configured to have an inertia mass larger than that of the release button 180. Therefore, the counterweight 200 can reliably prevent the release button 180 from sliding into the buckle 100 under inertia.

The second rotating shaft 204 has a portion (a flat surface in the present embodiment) in which part of the outer peripheral surface is missing at a position that is in contact with the bearing groove 192 of the release button 180 preferably in a state in which the sliding distance of the release button into the outer case is the largest. FIG. 3(*b*) is a side enlarged view of the second rotating shaft 204. The second rotating shaft 204 illustrated by FIG. 3(*b*) is shown in a posture such that the latching portions 212 of the counterweight 200 are positioned to face to the right and the second rotating shaft 204 is positioned vertically below the first rotating shaft 202. As shown in FIG. 3(*b*), the second rotating shaft 204 is provided with a first cut-out portion 208 and a second cut-out portion 210 as the portions in which part of the outer peripheral surface is missing. The first cut-out portion 208 is provided over almost the entire width of the second rotating shaft at a position on the left side and upper side of the second rotating shaft 204 in the posture shown in FIG. 3(*b*). The second cut-out portion 210 is provided at the lower side of the second rotating shaft 204 in the posture shown in FIG. 3(*b*).

As shown in FIG. 3(*b*), the distances D1, D3 between the points on the cut-out portions 208, 210 and the center of the second rotating shaft 204 are less than the respective distances D2, D4 between the points on the outer circumference in the case of a virtual circle representing the second rotating shaft 204 that has no missing portions and the center of the second rotating shaft. Further, in the present embodiment, the cut-out portions 208, 210 are provided as flat surfaces (portions in which parts of the outer circumferential surface of the second rotating shaft 204 are missing), but such a shape is not limiting. The cut-out portions 208, 210 may also be curved surfaces, rather than flat surfaces, provided that they are pulled back from the outer circumferential surface of the second rotating shaft 204 toward the center of the circle.

As shown in FIG. 3(*c*), the latching portions 212 that latch onto the lock bar 172 are provided at the distal end of the counterweight 200 on the inner side of the buckle 100. The latching portions 212 latch onto the lock bar 172 at a position in a state in which the tongue plate 102 has latched onto the latch member 140. Therefore, it is possible to use the counterweight 200 that can rotate with respect to the outer case 110 and aid the latching of the tongue plate 102 with the latch member 140. As a result, the latched state of the tongue plate 102 in a seat belt buckle device can be maintained more reliably.

(Operation of Seat Belt Buckle Device)

Figure 4:
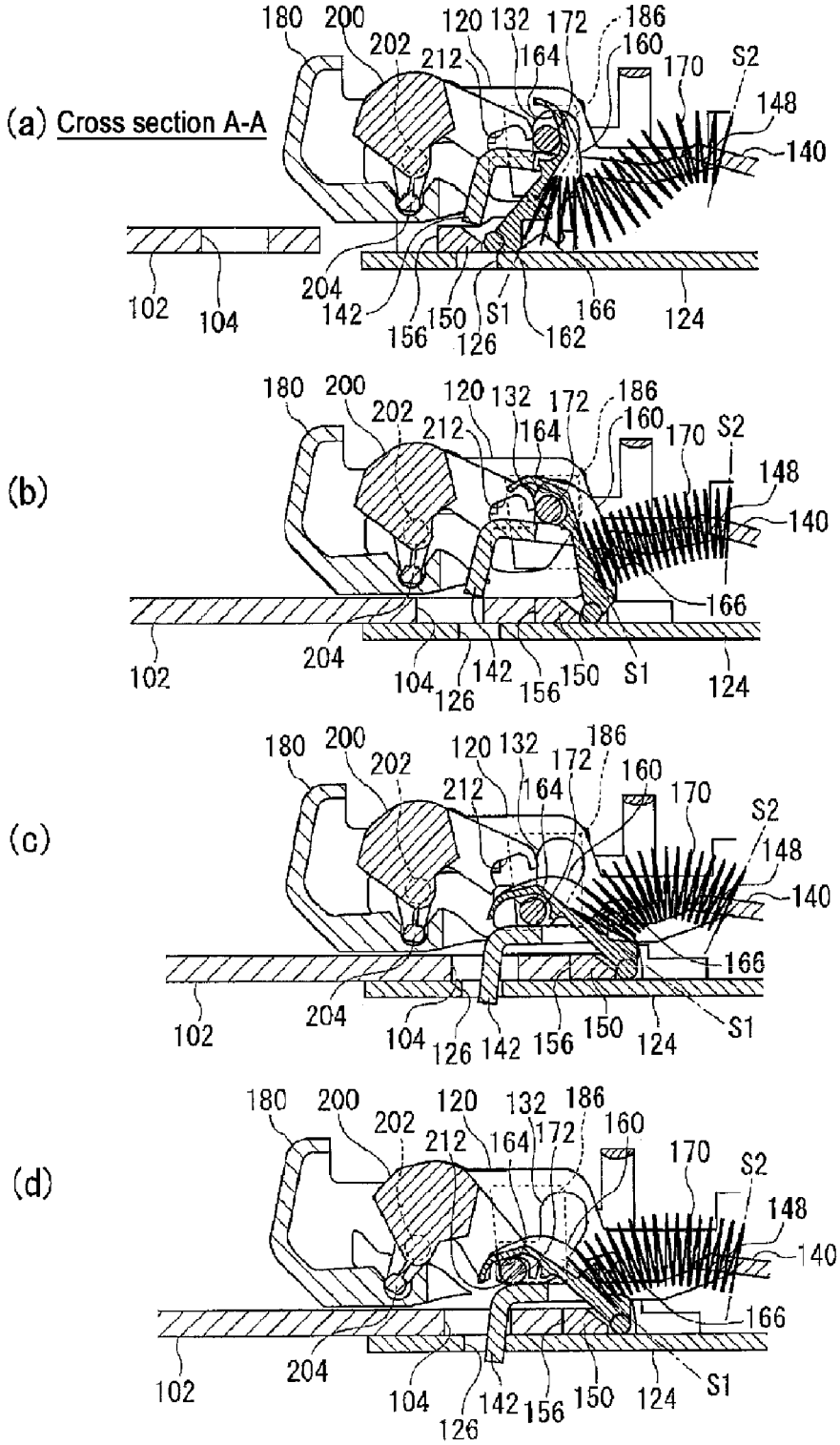
FIGS. 4(*a*)-4(*d*) are sectional views taken along the A-A line in FIG. 1; these views illustrating the operation of the seat belt buckle device from the initial state to the latched state.

FIGS. 4(*a*)-4(*d*) are sectional views taken along the A-A line in FIG. 1 and illustrate the operation of the seat belt buckle device from the initial state to the latched state. The A-A section in FIG. 1 is the section in the Y1/Y2 direction in the figure and the Z1/Z2 direction in the figure. In FIGS. 4(*a*)-4(*d*), the elements that are irrelevant to the operation of the seat belt buckle device are omitted. The initial state, as referred to herein, is an unlatched state in which the seat belt is not worn and the tongue plate 102 is not latched onto the buckle 100. The latched state, as referred to herein, is a state in which the occupant wears the seat belt and the tongue plate 102 is latched onto the buckle 100. In the explanation below, the tongue insertion port side and opening 112 side are at the left side in the figure, and the buckle inner side is at the right side in the figure.

FIG. 4(*a*) illustrates the initial state of the buckle 100. As shown in FIG. 4(*a*), in the initial state, the ejector 150 is caused to slide toward the tongue insertion port side by the repulsion force of the ejector spring 170. The cantilever 160 is in a state in which it is tilted clockwise about a shaft portion 162. The cantilever 160 also pushes the lock bar 172 toward the opening 112. Since the lock bar 172 is positioned in the upper portion of the guide hole 132 and pushed by the cantilever 160, the lock bar comes into contact with a substantially vertical edge, as shown in FIG. 4(*a*), which is the opening 112 side of the guide hole 132.

Since the cantilever 160 is in the state in which it is tilted clockwise, the vertical position of the spring holding protruding portion 166 is closer than the vertical position of the spring latching projecting portion 148 of the latch member 140 to the bottom wall side of the frame 120. Therefore, the ejector spring 170 is curved in a S-like shape. In this case, in the ejector spring 170, the end surface S1 on the spring holding protruding portion side and the end surface S2 on the spring latching projecting portion side are not parallel to each other, and the end surface S1 transmits a repulsion force from obliquely below the spring holding protruding portion side of the cantilever 160 as shown in FIG. 4(*a*).

The latch member 140 is biased by the repulsion force of the ejector spring 170 in the clockwise direction about the support arm 144 (see FIG. 2). As a result, the latch protrusion 142 of the latch member 140 separates from the bottom surface 124 of the frame 120 and an insertion path for the tongue plate 102 is ensured between the bottom wall 124 and the latch protrusion 142.

FIG. 4(*b*) shows a state in which the tongue plate 102 is inserted into the buckle. The end portion of the tongue plate 102 comes into contact with the pushed portion 156 of the ejector 150, and the ejector 150 is caused to slide in the insertion direction of the tongue plate 102. In this case, the shaft portion 162 of the cantilever 160 slides together with the ejector 150 against the repulsion force of the ejector spring 170. Meanwhile, the bar latching portion 164 of the cantilever 160 pushes the lock bar 172 by the repulsion force of the ejector spring 170. Therefore, the cantilever 160 rotates counterclockwise about the lock bar 172 from the state shown in FIG. 4(*a*) to the state shown in FIG. 4(*b*).

In the state shown in FIG. 4(*b*), the cantilever 160 rotates counterclockwise and therefore the vertical position of the spring holding protruding portion 166 gets close to the vertical position of the spring latching projecting portion 148 of the latch member 140. In the state shown in FIG. 4(*b*), the end surface S1 is tilted counterclockwise from the state shown in FIG. 4(*a*), and the end surface S1 and the end surface S2 are closer to being parallel to each other than in the state shown in FIG. 4(*a*). Therefore, in the state shown in FIG. 4(*b*), the S-like curved shape of the ejector spring 170 is released.

FIG. 4(*c*) shows a state in which the tongue plate 102 is further inserted into the buckle from the state shown in FIG. 4(*b*). In this state, the ejector 150 further slides into the buckle 100, and the cantilever 160 further rotates counterclockwise about the shaft portion 162. In this case, the ejector spring 170 is curved to protrude upward. Therefore, the end surface S1 of the ejector spring 170 transmits a repulsion force from obliquely above the spring holding protruding portion 166 side of the cantilever 160 to the cantilever 160.

The bar latching portion 164 of the cantilever 160 pushes the lock bar 172 down along the substantially vertical edge of the guide hole 132 toward the corner of the guide hole 132. The lock bar 172 that has been pushed down pushes the latch member 140 located therebelow, and the latch member 140 rotates about the support arm 144 (see FIG. 2) toward the tongue plate 102. As a result, the latch protrusion 142 is inserted into the latch hole 104 of the tongue plate 102 and then inserted into the orifice 126 of the bottom wall 124 of the frame 120, and the tongue plate 102 is latched onto the buckle 100.

FIG. 4(*d*) shows a state in which the release button 180 slightly slides in the direction of the opening from the state shown in FIG. 4(*c*). In the state shown in FIG. 4(*c*), the lock bar 172 that has been pushed down by the cantilever 160 and went over the corner of the guide hole 132 can move in the direction of the opening inside the guide hole 132. The surface of the operation recess 186 of the release button 180 on the opening side is pushed in the direction of the opening by the lock bar 172 that has received the repulsion force of the ejector spring 170. Therefore, the release button 180 slightly slides in the direction of the opening, and the counterweight 200 rotates clockwise about the first rotating shaft 202. Because of such rotation, the latching portion 212 of the counterweight 200 comes into contact with the upper side of the lock bar 172 and latches there onto. In a state in which the latch member is latched onto the tongue plate, the lock bar can move horizontally (as shown in the figure) inside the guide hole 132, but this movement is prevented by the latching portion of the counterweight. As a result, the latching of the tongue plate 102 is completed and the buckle 100 assumes the latched state.

Figure 5:
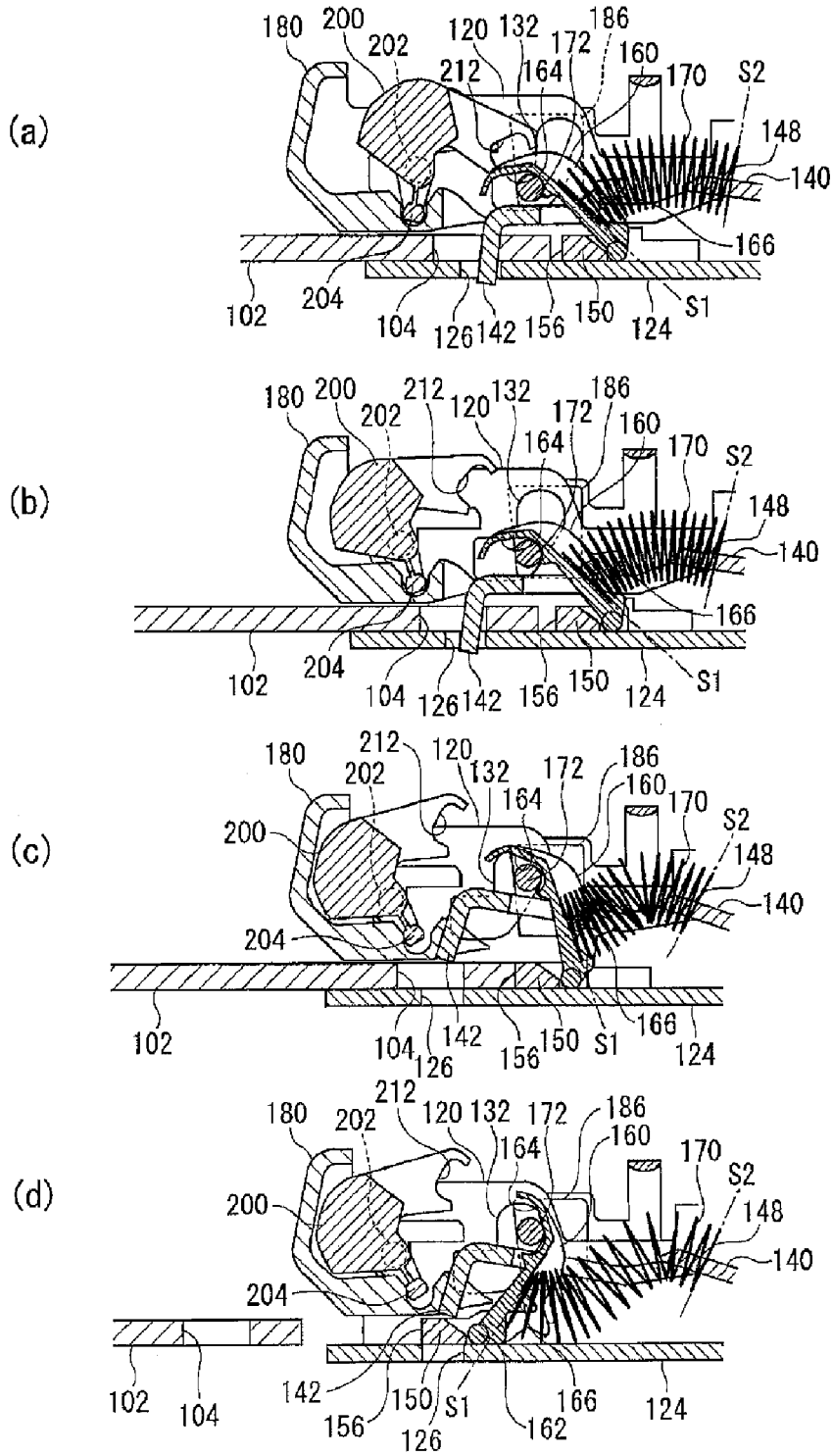
FIGS. 5(*a*)-5(*d*) are sectional views of the release operation of the seat belt buckle device from the latched state.

FIGS. 5(*a*)-5(*d*) illustrate the release operation performed from the latched state of the seat belt buckle device. FIG. 5(*a*) illustrates a state in which the release button 180 is pushed from the latched state shown in FIG. 4(*d*). Where the release button 180 is pushed by an occupant and the release button 180 slides in the direction into the buckle 100, the counterweight 200 initially rotates counterclockwise about the first rotating shaft 202 and the latching of the lock bar 172 by the latching portion 212 is released. Then, the lock bar 172 is pushed by the surface of the operation recess 186 on the opening side in the direction into the buckle 100 and moves there into. In this case, since the lock bar 172 is pushed, the cantilever 160 and the ejector 150 also move in the direction into the buckle 100. As a result, the ejector spring 170 is compressed.

Where the release button 180 is further pushed from the state shown in FIG. 5(*a*), the lock bar 172 comes into contact with the curved edge of the guide hole 132 as shown in FIG. 5(*b*). Further, as shown in FIG. 5(*c*), the lock bar 172 rises along the curved edge of the guide hole 132, while being pushed by the surface of the operation recess 186 on the opening side.

As shown in FIG. 5(*c*), in a state in which the release button 180 has slid into the interior of the buckle 100, the cantilever 160 rotates clockwise about the shaft portion 162 and assumes a tilted state. In this case, the vertical position of the spring holding protruding portion 166 is closer to the bottom wall side of the frame 120 than the vertical position of the spring latching projecting portion 148 of the latch member 140. Therefore, the ejector spring 170 assumes an S-like curved shape. In this case, the end surface S2 of the ejector spring 170 causes the latch member 140 to rotate in the clockwise direction about the support arm 144 (see FIG. 2) via the spring latching projecting portion 148. As a result, the latch protrusion 142 of the latch member 140 rises from the latch hole 104 of the tongue plate 102, and the latching of the tongue plate 102 is released.

The end surface S1 of the ejector spring 170 pushes the cantilever 160 in the direction to the opening. Therefore, where the latching of the tongue plate 102 is released, the cantilever 160 and the ejector spring 170 slide with force in the direction to the opening under the effect of the ejector spring 170, as shown in FIG. 5(*d*). As a result, the tongue plate 102 is pushed out from the tongue insertion port 114. Where the occupant removes the hand from the release button 180, the surface of the operation recess 186 on the opening side is pushed toward the opening by the lock bar 172 that has received the repulsion force of the ejector spring 170, the release button 180 slides toward the opening, and the buckle 100 returns to the initial state shown in FIG. 4(*a*).

Figure 6:
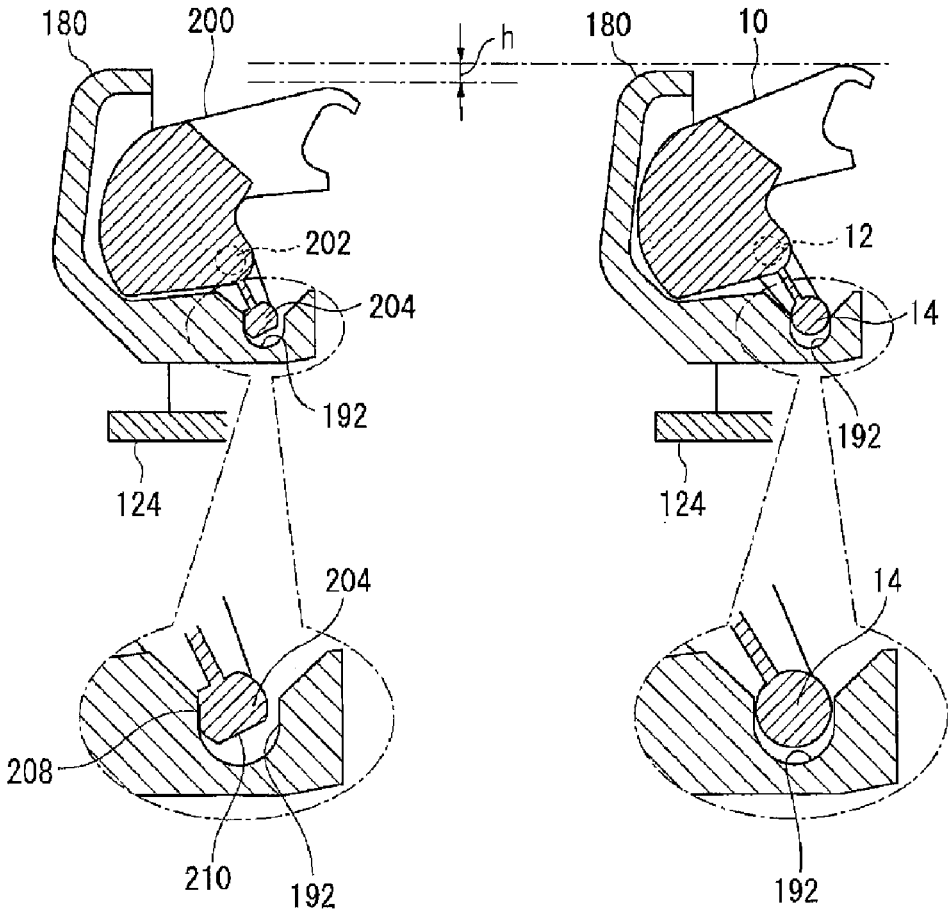
FIG. 6 illustrates the comparison of the seat belt buckle device according to the present embodiment and a seat belt buckle device of a comparative example.

In FIG. 6, the seat belt buckle device according to the present embodiment is compared with a seat belt buckle device of a comparative example. As shown in FIG. 6, the buckle 100 according to the present embodiment is provided with the counterweight 200 having the first cut-out portion 208 at the second rotating shaft 204. Meanwhile a second rotating shaft 14 of a counterweight 10 of the comparative example has a round cross section.

Both in the embodiment and the comparative example, the state shown in FIG. 6 is assumed where the release button 180 is caused to slide completely into the buckle 100 when the latching of the tongue plate 102 is released. In this state, the second rotating shaft 204 of the present embodiment is brought into contact with a substantially vertical flat plate of the bearing groove 192 of the release button 180 by the first cut-out portion 208. Comparing with the second rotating shaft 14 of the comparative example, although the sliding distance of the release button 180 is the same as in the comparative example, the distance of rightward movement (FIG. 6) of the second rotating shaft 204 of the present embodiment is shorter due to the presence of the first cut-out portion 208. Therefore, the rotation amount of the counterweight 200 of the present embodiment about the first rotating shaft 202 is reduced with respect to the rotation amount of the counterweight 10 of the comparative example about the first rotating shaft 12. Therefore, in the present embodiment, the jumping height of the counterweight 200 is lower by the height h than the jumping height of the counterweight 10.

Since the counterweight 200 is also provided with the second cut-out portion 210, in the case where the first rotating shaft 202 and the second rotating shaft 204 are positioned substantially vertically, the distance between the center of the second rotating shaft 204 and a point on the second cut-out portion 210 located substantially vertically therebelow (distance D3 in FIG. 3) is shorter than the distance between the center of the second rotating shaft 14 and a point on the circumference located substantially vertically therebelow (distance D4 in FIG. 3). Since the second cut-out portion 210 is present, a gap is provided between the second rotating shaft and the bearing groove 192 and the interference with the bearing groove 192 is reduced. As a result, the release button 180 can be caused to slide smoothly.

With the above-described configuration, in the buckle 100 according to the present embodiment, the space for allowing the counterweight 200 to rotate can have a small width, the thickness of the outer case 110 (thickness in the Z1 direction and Z2 direction in FIG. 1) can be reduced, and the buckle of reduced size can be designed.

Figure 7:
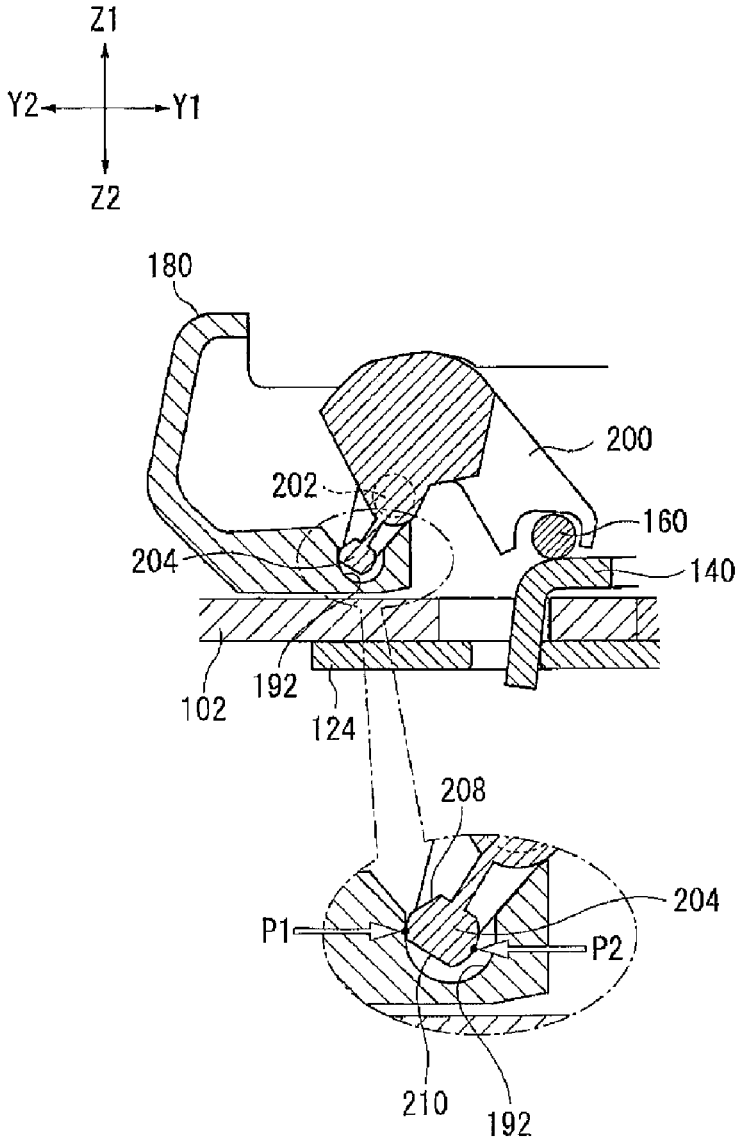
FIG. 7 illustrates the state of contact of the counterweight and the release button in the latched state.

FIG. 7 illustrates the contact of the counterweight 200 and the release button 180 in the latched state. FIG. 7 is an enlarged view of the counterweight 200 in the buckle 100 in the latched state shown in FIG. 4(*d*).

In the buckle 100 in the latched state, the counterweight 200 functions as a weight that rotates and offers resistance to the sliding of the release button 180. In the latched state, the second rotating shaft 204 of the counterweight 200 is in contact with the bearing groove 192 of the release button 180 by the outer circumferential surface outside of the portions in which part of the outer circumferential surface is missing (cut-out portions 208, 210). For example, the second rotating shaft 204 shown in FIG. 7 can be in contact with the bearing groove 192 at contact points P1, P2 that are shown schematically in the figure.

The contact point P1 is in contact with the bearing groove 192 when the release button 180 slides in the Y1 direction shown in the figure (in the direction into the buckle 100). The release button 180 slides in this direction, for example, when an acceleration is applied to the buckle 100 in the Y1 direction shown in the figure under the inertia occurring in the event of an accident or the like. In this case, the release button 180 is prevented from sliding in the Y1 direction in the figure by the resistance offered by the second rotating shaft 204 to which a load is applied in the direction of clockwise rotation about the first rotating shaft 202 by the abovementioned acceleration in the Y1 direction shown in the figure. Therefore, the latching of the tongue plate 102 is maintained.

The contact point P2 is in contact with the bearing groove 192 when the release button 180 slides in the Y2 direction shown in the figure (direction toward the tongue insertion port 114) or when the counterweight 200 rotates in the counterclockwise direction as shown in FIG. 7. The sliding of the release button 180 and the rotation of the counterweight 200 in those directions occur, for example, when an acceleration in the Y2 direction shown in the figure is applied to the buckle 100 under the inertia. The weight and center of gravity of the counterweight 200 are designed such that the counterweight does not rotate in the counterclockwise direction and does not cause the release button 180 to slide in the Y1 direction shown in the figure. In other words, the counterclockwise rotation of the counterweight 200 is prevented by the resistance offered by the release button 180 sliding in the Y2 direction shown in the figure. Therefore, the latching of the tongue plate 102 is maintained.

In the latched state of the buckle 100, that is, when the counterweight 200 functions as a weight, the portions (in particular, the first cut-out portion 208) of the second rotating shaft 204 in which part of the outer circumferential surface is missing are not in contact with the release button 180. In other words, the first cut-out portion 208 is formed such that it is not in contact with the bearing groove 192 in the latched state of the buckle 100. As described hereinabove, in the latched state, the second rotating shaft 204 is in contact with the bearing groove 192 by the outer circumferential surface outside the portion in which part of the outer circumferential surface is missing (portion outside the first cut-out portion 208). Even if the posture of the counterweight 200 is somewhat disturbed, the first cut-out portion 208 does not come into contact with the bearing groove 192 in the latched state. Therefore, although the second rotating shaft 204 is provided with the first cut-out portion 208, no adverse effect is produced on the aforementioned functions of the counterweight 200.

As explained hereinabove with reference to FIG. 6(*a*), the first cut-out portion 208 of the second rotating shaft 204 comes into contact with the bearing groove 192 when the sliding distance of the release button 180 into the outer case 110 is the largest. With such a configuration, the portion of the second rotating shaft 204 in which part of the outer circumferential surface is missing produces no adverse effect on the aforementioned functions of the counterweight 200 and the jumping height of the counterweight can be reduced.

The preferred embodiments of the present invention are described hereinabove with reference to the appended drawings, but the above embodiments are merely preferred examples of the present invention, and other embodiments may be also implemented or executed using various methods. In particular, the present invention is not limited to the shapes, dimensions, and arrangement of the components illustrated in detail in the appended drawings, unless specific limiting description to the contrary is provided in the specification of the present application. Further, expressions and terms used in the specification of the present application are employed for descriptive purposes only, and the present invention is not limited to these expressions and terms unless specifically stated otherwise.

Therefore, it is clear that a person skilled in the art could conceive of various variation examples or modification examples without departing from the scope defined by the claims, and those variation examples and modification examples are also construed to be included in the technical scope of the present invention.

We claim:

1. A seat belt buckle device that fixes a tongue plate provided at a seat belt, comprising an outer case into which the tongue plate is inserted;

a latch member rotatably mounted within the outer case and configured to rotate in response to the insertion of the tongue plate into the outer case and latches the tongue plate;

a release button slideably mounted within the outer case and configured to release latching of the tongue plate by the latch member by sliding into the outer case; and a counterweight mounted within the outer case and configured to be rotated by a force received from the release button while resisting sliding of the release button, wherein the counterweight has:

a first rotating shaft rotatably supporting the counterweight with respect to the outer case;

a second rotating shaft that is engaged with a bearing groove formed in the release button and configured to receive the force that rotates the counterweight due to the sliding of the release button, and the second rotating shaft having an outer circumferential surface including a first outer surface and a second outer surface, the first outer surface defining multiple portions of the outer circumferential surface along a virtual circle defined by the first outer surface, the second outer surface being a recessed portion that is recessed inward toward a center of the virtual circle, the second outer surface contacting the bearing groove of the release button when the release button slides into the outer case.

2. The seat belt buckle device according to claim 1, wherein the first outer surface contacts the bearing groove of the release button when the seat belt buckle device fixes the tongue plate; and the second outer surface contacts the bearing groove of the release button when a sliding distance of the release button into the outer case is the largest.

3. The seat belt buckle device according to claim 1, further comprising a lock bar moveably mounted within the outer case and configured to receive a force from the tongue plate, rotate the latch member toward the tongue plate and latch the latch member, wherein the counterweight has a latching portion that latches the lock bar at a position in which the latch member is latched onto the tongue plate.

4. The seat belt buckle device according to claim 1, wherein the counterweight is made from a metal and has an inertia mass larger than that of the release button.

5. The seat belt buckle device according to claim 1, wherein the second outer surface is a flat surface of the second rotating shaft.

6. The seat belt buckle device according to claim 1, wherein the second outer surface is located on a side of the second rotating shaft generally facing toward an opening through which the tongue plate is inserted.

7. The seatbelt buckle device according to claim 1, wherein the second outer surface extends between two points on the virtual circle.

8. The seatbelt buckle device according to claim 1, wherein the second outer surface forms a chord of the virtual circle.

9. The seatbelt buckle device according to claim 1, wherein the first outer surface contacts the bearing groove of the release button when the seatbelt buckle device fixes the tongue plate.

10. The seatbelt buckle device according to claim 1, wherein the second outer surface contacts the bearing groove of the release button when a sliding distance of the release button into the outer case is the largest.

11. A seat belt buckle device that fixes a tongue plate provided at a seat belt, comprising:

an outer case into which the tongue plate is inserted;

a latch member rotatably mounted within the outer case and configured to rotate in response to the insertion of the tongue plate into the outer case and latches the tongue plate;

a release button slideably mounted within the outer case and configured to release latching of the tongue plate by the latch member by sliding into the outer case; and a counterweight mounted within the outer case and configured to be rotated by a force received from the release button while resisting sliding of the release button, wherein the counterweight has:

a first rotating shaft rotatably supporting the counterweight with respect to the outer case;

a second rotating shaft having a center point and engaging a bearing groove formed in the release button, the second rotating shaft being configured to receive the force that rotates the counterweight due to the sliding of the release button, the second rotating shaft having an outer circumferential surface including a first outer surface and a second outer surface, the first outer surface located at a first distance from the center point and the second outer surface being located at a second distance from the center point, the second distance being less than the first distance, the first outer surface contacting the bearing groove of the release button when the seatbelt buckle device fixes the tongue plate and the second outer surface contacting the bearing groove of the release button when the release button slides into the outer case.

12. The seatbelt buckle device according to claim 11, wherein the first outer surface defines a portion of the outer circumferential surface along a virtual circle and the second outer surface is a recessed portion that is recessed inwardly toward the center point from the virtual circle.

13. The seatbelt buckle device according to claim 11, wherein all points along the second outer surface are located less than the first distance from the center point.

14. The seatbelt buckle device according to claim 11, further comprising a lock bar moveably mounted within the outer case and configured to receive a force from the tongue plate, rotate the latch member towards the tongue plate and latch the latch member, wherein the counterweight has a latching portion that latches the lock bar at a position in which the latch member is latched onto the tongue plate.

15. The seatbelt buckle device according to claim 11, wherein the counterweight is made from a metal and has an inertial mass larger than that of the release button.

16. The seatbelt buckle device according to claim 11, wherein the second outer surface is a flat surface.

17. The seatbelt buckle device according to claim 11, wherein the second outer surface is located on a side of the second rotating shaft generally facing toward an opening through which the tongue plate is inserted.

18. The seatbelt buckle device according to claim 11, wherein the first outer surface defines a portion of the outer circumferential surface along a virtual circle and the second outer surface extends and the second outer surface that extends between two points on the virtual circle.

19. The seatbelt buckle device according to claim 11, wherein the first outer surface defines a portion of the outer circumferential surface along a virtual circle and the second outer surface forms a chord of the virtual circle.

* * * * *